United States Patent [19]

Hynes et al.

[11] Patent Number: 4,657,263

[45] Date of Patent: Apr. 14, 1987

[54] ANNULAR PACKING UNIT AND INSERT

[75] Inventors: Joseph H. Hynes; James A. Burton, both of Houston, Tex.

[73] Assignee: Hydril Company, Los Angeles, Calif.

[21] Appl. No.: 670,132

[22] Filed: Oct. 19, 1984

Related U.S. Application Data

[63] Continuation of Ser. No. 485,619, Apr. 18, 1983, abandoned.

[51] Int. Cl.[4] ..... F16J 15/12; F21B 33/06

[52] U.S. Cl. ..... 277/31; 277/199; 251/1.3

[58] Field of Search ..... 277/31, 73, 199, 235 R; 251/1.1, 1.2, 1.3

[56] References Cited

U.S. PATENT DOCUMENTS

| | | | |
|---|---|---|---|
| 2,609,836 | 9/1952 | Knox | 251/1 B X |
| 2,812,197 | 11/1957 | Gibson . | |
| 2,832,617 | 4/1958 | Gibson . | |
| 2,846,178 | 8/1958 | Minor . | |
| 3,323,773 | 6/1967 | Walker | 251/1 B |
| 3,533,468 | 10/1970 | Lewis et al. | 251/1 B X |
| 3,561,723 | 2/1971 | Cugini | 251/1 B |
| 3,591,125 | 7/1971 | Lewis | 251/1 B |
| 3,917,293 | 11/1975 | Lewis et al. | 277/235 R X |
| 3,958,808 | 5/1976 | Lewis et al. | 277/73 X |
| 4,447,037 | 5/1984 | Huey et al. | 251/1.3 |
| 4,452,421 | 6/1984 | Huey et al. | 251/1.3 |
| 4,461,448 | 7/1984 | Huey et al. | 251/1.3 |

FOREIGN PATENT DOCUMENTS 2100775 1/1983 United Kingdom .

*Primary Examiner*—Robert S. Ward

*Attorney, Agent, or Firm*—Dodge, Bush & Moseley

[57] ABSTRACT

A packer unit and packer insert adapted for use in an annular blowout preventer. The packer insert includes a generally longitudinal web with its leading edge facing the axial bore of the packing unit sloping from top to bottom in a generally radially outward direction.

8 Claims, 4 Drawing Figures

ANNULAR PACKING UNIT AND INSERT

This application is a continuation of application Ser. No. 485,619, filed Apr. 18, 1983, and now abandoned.

BACKGROUND OF THE INVENTION

1. Field of the Invention

This invention relates generally to annular blowout preventers and more particularly to a packing unit and insert for such packing unit. More particularly, the invention relates to an insert for an annular packing unit for imparting significantly longer cycle life to the packing unit when it is periodicly tested during drilling operations.

2. Description of the Prior Art

For many years the design of blowout preventer packing units has followed the principles described in U.S. Pat. No. 2,609,836 to Knox. Such packing units incorporate metal inserts equally spaced about the packer longitudinal axis and embedded in an elastomeric material. Upon inward constriction or closure of the unit about a well drill pipe, the elastomeric material is anchored by the insert webs as it produces vertical folds stretching radially inwardly to seal the pipe. When the packer unit closes on itself as in the case when no pipe is present in the longitudinal bore of the unit, elastomeric material of the folds advancing toward the axis must at certain times stretch or extend as much as 350 to 400%. Repeated closures produce excessive wear and fatigue of the elastomeric or rubber material, reducing the useful life of the packer due to such extreme stretching.

U.S. Pat. Nos. 3,958,808 and 3,917,293 disclose a packing unit and inserts for such a packing unit which significantly increase the packing unit cycle lifetime. The increase in cycle lifetime results from locating the insert webs in the elastomeric material with spacing from the central longitudinal axis and from each other in a differential manner in order to provide differential anchoring about the axis of circularly spaced portions of the elastomeric material subject to inward displacement. Rubber flow paths are opened between the inserts.

In one form of the invention disclosed in the above referenced patents, the anchoring of the rubber by certain webs is closer to the central axis than anchoring of the material by other webs. In other words, webs effectively closer to and further from the axis may alternate about the axis. In other forms of the invention, the webs are generally equally spaced from the axis but certain pairs of the webs have closer circular spacing about that axis than other pairs of webs. Significant increases in packer cycle life are achieved by the invention disclosed in the above referenced patents. A continuing need exists, however, for increases in packer cycle life over and above those achieved by the above referenced inventions.

Thus, it is an object of the invention to provide a packer and an insert designed for the packer which produces increased packer unit cycle life.

It is another object of the invention to provide a packer and an insert for use therein which produces a reversing of the pressure profile on the pipe moving the peak pressure to the lower end of the packing unit thereby producing less extrusion about the top plate of the packing unit, with resulting increase in cycle life of the packer unit.

It is a further object of the invention to provide an insert for an annular packing unit in which the elastomeric material in which the insert is embedded is placed in compression at the top portion of the web connecting the upper plate with the lower plate thereby tending to force the elastomeric material toward the web when the packer unit is closing on a pipe or other object in the packer unit bore, thereby reducing tearing and extrusion above the top plate of the packing unit.

SUMMARY

According to the invention, an insert adapted for use in an annular blowout preventer packing unit is provided. The packing unit comprises elastomeric material embedding one or more of the inserts according to th invention and includes a longitudinal axis and bore for accepting pipe or other objects about which it is adapted to close in the event of a blowout in a well.

The inserts include top and bottom plates interconnected by a generally longitudinal web. The inner edge of the web slopes generally from a relatively inward radius near the top plate to a relatively outward radius near the bottom plate. The packer unit and the insert, according to the invention, produce an axial pressure profile when closing about a pipe or other object in the longitudinal bore of the packing unit which is relatively lower longitudinally on the pipe than prior packing units thereby resulting in a relatively longer cycle life of the packing unit.

BRIEF DESCRIPTION OF THE DRAWINGS

The foregoing summary of the invention and other objects and advantages of the invention will be described in more detail below taken in conjunction with the accompanying drawings of which.

DESCRIPTION OF THE INVENTION

Figure 1:
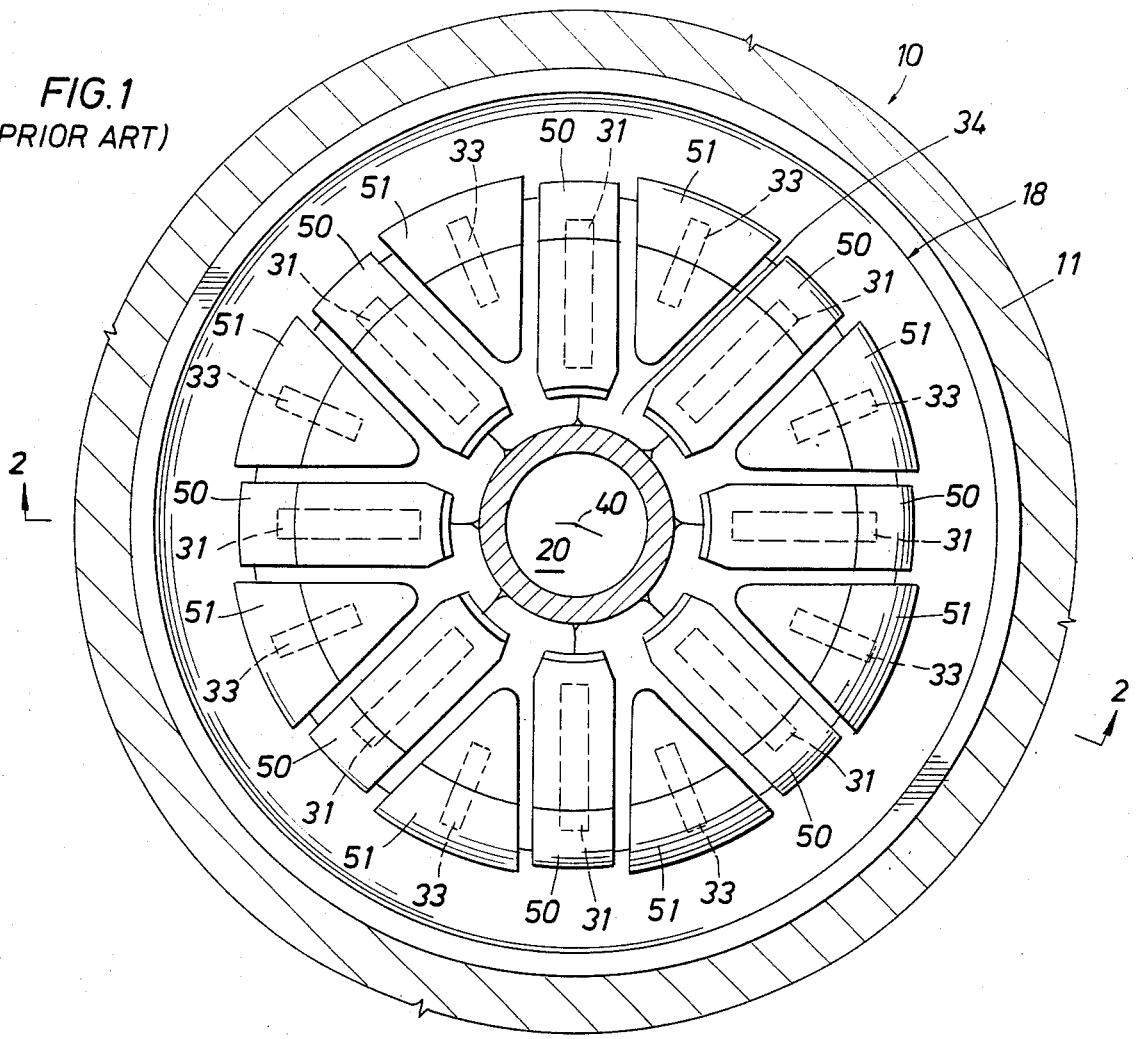
FIG.1 (PRIOR ART)
FIG. 1 illustrates in a top cross-section view a prior art annular packing unit constructed generally according to one embodiment of a long life packing unit illustrated in U.S. Pat. Nos. 3,958,808 and 3,917,293 and having prior art inserts similar in design to the insert illustrated in FIG. 4 and having a web inner edge which slopes generally downwardly in an inwardly radial direction from the axis of the bore.

FIG. 1 illustrates in a cross-section view a prior art packing unit disclosed in U.S. Pat. Nos. 3,958,808 and 3,917,293. The invention to be described in detail below is related to the blowout preventers disclosed in such U.S. patents and are owned by the same assignee which owns the subject invention. The subject matter of both of the issued patents referenced above is incorporated by reference herein as though fully set forth. The invention described and claimed below relates to a novel insert design which when substituted for the inserts illustrated in FIG. 1 and FIG. 4, results in an improved packer unit for an annular blowout preventer.

Figure 2:
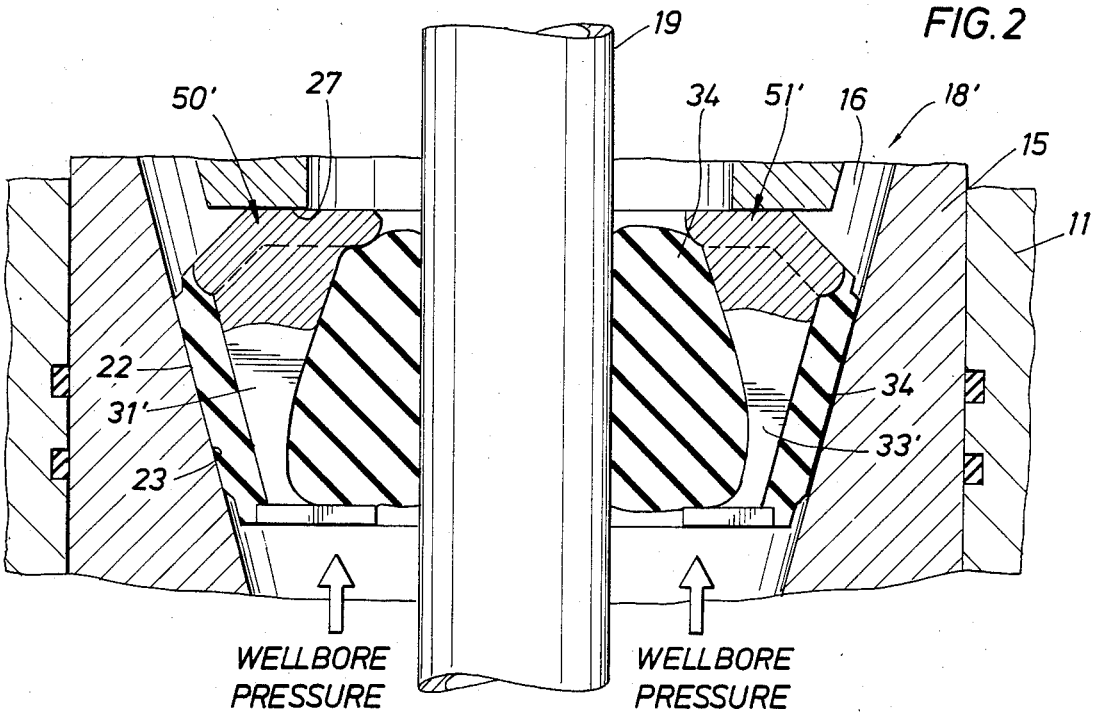
FIG. 2 illustrates the novel shape of the webs of the inserts according to the invention which may be substituted for the prior art inserts of the packing unit of FIG. 1, thereby producing an improved packing unit.

FIG. 1 illustrates a prior art annular blowout preventer 10 and packing unit 18 having two differently shaped inserts 50 and 51 alternatingly spaced about the periphery of the packing unit. The inserts 50 and 51 are embedded in elastomeric material 34. FIG. 2 illustrates an improved packing unit similar in construction to that illustrated in FIG. 1, but in which inserts 50′ and 51′ according to the invention are substituted for the prior art inserts 50 and 51 of FIG. 1.

FIG. 2 shows the novel inserts 50′ and 51′ in an improved packing unit 18′ in annular blowout preventer which includes as is standard in the art of annular blowout preventers, a metallic housing 11 which may be bolted to wellhead casing and other well equipment. The housing 11 contains a piston 15 movable upward in chamber 16 in response to fluid pressure exerted upwardly against the piston for radially constricting the improved annular packer unit 18′ via pressure exertion from piston cam surface 22 against packer exterior surface 23. Surfaces 22 and 23 are preferably frusto-conical and flared upwardly. The improved packer 18′ when sufficiently radially inwardly displaced seals off about a well pipe 19 shown extending axially vertically through the preventer 10 in FIG. 2 and in the absence of a pipe, the improved packer unit 18′ will completely close off the vertical passage 20 through the preventer when the unit is sufficiently constricted by piston 15. Upon downward movement of the piston, the improved packer 18′ expands radially outward to the open position. The improved packer unit 18′ is as standard practice in the art of annular blowout preventers normally confined vertically under a housing cap, the lower interior surface 27 of which is illustrated in FIG. 2.

In the prior art blowout preventer disclosed in the patents referenced above and illustrated in FIG. 1, the prior art packer unit 18 has prior art metal inserts 51 and 50 generally circularly spaced about the longitudinal central axis of the unit 40. The prior art inserts 50 and 51 including webs 31 and 33 extend generally longitudinally. An annulus of elastomeric material 34 extending about the packer axis embeds the webs so that they anchor the material toward inward compressive displacement for constriction of the packer. The spacing of the webs from the axis and from each other creates differential anchoring about the axis of circularly spaced portions of the elastomeric material subject to inward displacement about the axis. As indicated in the referenced patents such differential anchoring facilitates differential inward flow or extrusion of circularly spaced portions of the elastomeric material to the end that maximum stretching of the material is minimized and maximum stresses are correspondingly minimized.

Figure 4:
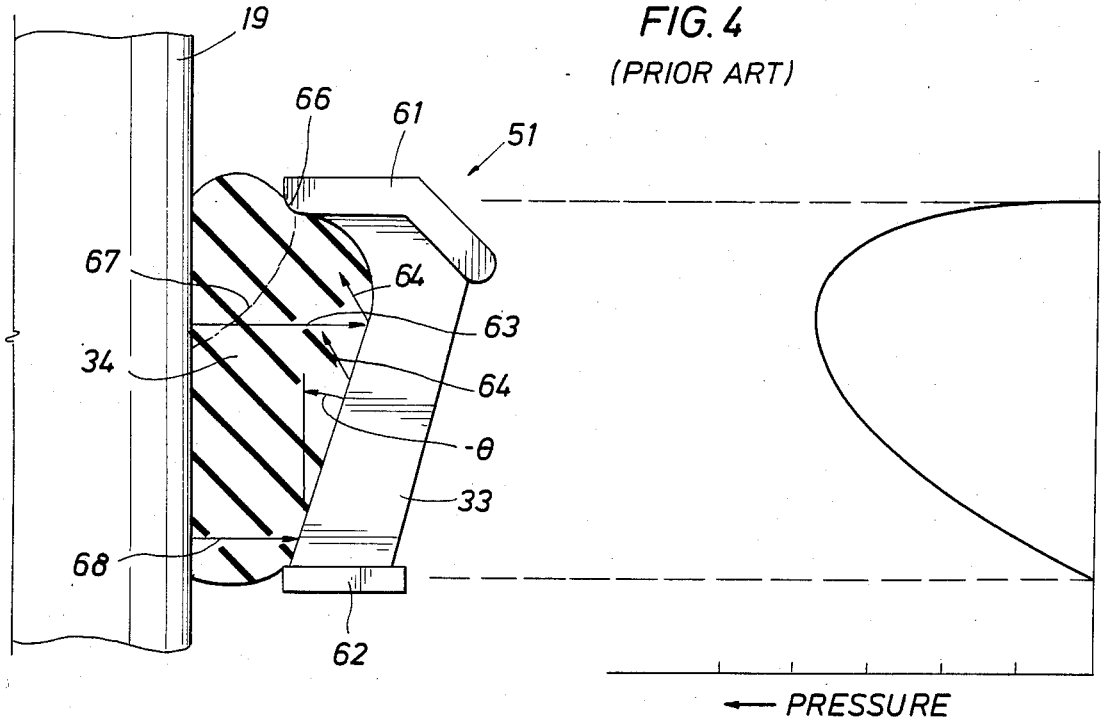
FIG. 4 (PRIOR ART)
FIG. 4 illustrates the web shape of a prior art insert and a corresponding pressure profile resulting from its use in a packing unit of an annular blowout preventer.

Turning now to FIG. 4, a prior art insert 51 (or alternatively 50) is illustrated as the packer unit in which it is a part is being closed about pipe 19. The web 33 of insert 51 is integral with a top plate 61 and a bottom plate 62. The shape of the top plate 61 and bottom plate 62 may be as those illustrated in FIG. 1 and FIG. 4 but are not important to this invention which is related to the inward edge shape of the prior art 33 web.

The prior art web 60 is characterized by a inward edge which slopes downwardly from a greater radius 63 to a smaller radius 68. In other words, the inward edge slopes downwardly from out to in. The prior art insert 51 illustrated in FIG. 4 is illustrated in the condition of upward well pressure tending to force the elastomeric material 34 upward thereby extruding it past the upper plate 61. The pressure profile of the prior art packing unit embedding a prior art insert 51 as shown to the right of FIG. 4 illustrates that the downwardly inwardly sloping inward edge of web 33 places the maximum point of pressure of the elastomeric material 34 against pipe 19 relatively high along the pipe. The arrows 64 showing the elastomeric material 34 along the upper part of web 33 of the inner edge of the prior art insert 51 indicate that the elastomeric material is in tension tending to force the elastomeric material away from the embedded insert 51 and web 33, as the packer unit is closing about pipe 19. Such tension is believed to contribute to the tearing about the upper ridge 66 of upper plate 61 during repetitive opening and closing of the packer, thereby contributing to a tearing off of the upper part of the elastomeric material 34 as shown by dotted lines 67.

Figure 3:
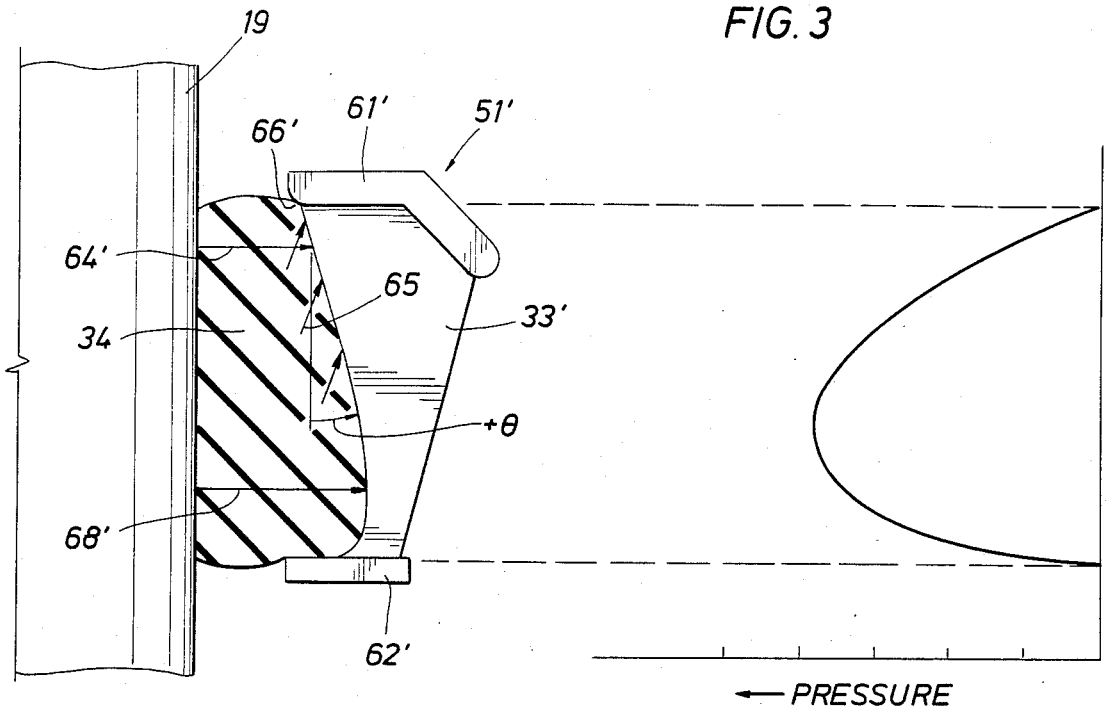
FIG. 3 illustrates the novel insert and the integral web according to the invention and illustrates the resulting pressure profile of an improved packing unit which incorporates the inserts when the improved packing unit is closed by an annular blowout preventer about a pipe.

In FIG. 3, an insert 51′ according to the invention or alternatively an insert 50′ which replace prior art inserts 51 or 50 of the prior art packer unit 18 illustrated in FIG. 1 is illustrated having a top plate 61′ and a bottom plate 62′ and a novel integral web 33′ constructed according to the invention. According to the invention, the inward edge of web 33′ slopes downwardly from a smaller upward radius 64′ to a larger downward radius 68′. In other words, the slope of the inward edge of the web of the insert slopes downwardly from a smaller radius to a larger radius. Another way to characterize the novel slope of the inner edge of web 33′ is that it is sloped creating a positive angle ($+\theta$) with respect to the longitudinal axis of the packing unit in which it is embedded. The shape of the inner edge of web 33′ is distinguished from the inner edge of web 33 of prior art insert 51 (see FIG. 4) which slopes at a negative angle ($-\theta$) with respect to the longitudinal axis of the packing unit in which it is embedded.

As illustrated in FIG. 3, the effect of the slope of the inward edge of web 60′ causes relatively more of the elastomeric material 34 to be trapped in the lower part of the inner edge of web 33′. Such slope on the inner edge of the web 33′ causes a lowering of the maximum point of the pressure profile against the pipe 19 about which the packer unit is closing as seen on the right hand side of FIG. 3. It is believed that the downwardly outwardly sloping inner edge of the web 33′ causes the elastomeric material to be placed in compression against the inner edge of the web 33′ as illustrated at arrows 65. Even though the entire packing element is placed in tension because of the upward force of the well pressure below the packing unit tending to cause separation of the elastomeric material 34 from pipe 19 during pack-off about pipe 19, the elastomeric material bonded to the inner edge of web 33′ is placed in compression. Less tearing at the upper edge 66′ at the top plate 61′ results from the compressive effect of the elastomeric material 34 at the top inner edge of web 33′.

FIG. 2 shows the preferred embodiment of the improved packer unit 18′ similar in construction to that illustrated in FIG. 1 but where insert 50′ having integral web 31′ and insert 51′ having integral web 33′ are provided rather than the prior art packer unit 18 of FIG. 1 which has inserts 50 with their webs 31 and inserts 51 with their webs 33. FIG. 2 showing the improved packer unit and inserts according to the invention is a section through lines 2—2 of FIG. 1 after the improved inserts 50′ and 51′ and their novel webs 31′ and 33′ have been substituted for prior art inserts 50 and 51. FIG. 2 illustrates the downward sloping inner edge from the smaller topmost inner radius to a larger lowermost inner radius of the inner edges of the webs 31' or 33' of inserts 50' or 51'.

Thus, the improved packer unit of elastomeric material with the novel inserts according to the invention is characterized by relatively more elastomeric material lower in the packer unit with more metal higher in the packer unit. The preferred range of internal angles of the inner edge of the webs of the inserts according to the invention is from a positive six (6) to twelve (12) degrees, depending on the geometry of the packer, causing the elastomeric material to move up into the upward part of the web (as illustrated in FIG. 3), rather than pulling away (as illustrated in the prior art insert of FIG. 4).

It should be emphasized that although the inserts are illustrated as being of the differential insert type as illustrated in FIGS. 1 and 2, the inserts may all be of indentical shape equally spaced about the radius of the packer unit like those, for example, of U.S. Pat. No. 2,609,836 issued to Knox. It should also be emphasized that the shape of the top plate 61' and bottom plate 62' may also be different from that illustrated in FIGS. 2 or 3.

Thus according to the invention, an insert and an improved packer embedding one or more of such inserts is provided in which the inner edge of the web slopes downwardly from a relatively smaller inner radius to a relatively greater radius. The shape of the inward edge of the web causes the rubber to be placed in relative compression at the upper inner edge of the web and thereby reduces tearing at its upper plate and places the pressure profile relatively lower along the pipe or other object in the bore of the packer unit during pack-off. Such lower pressure profile causes less tendency for tearing at the upper plate of the elastomeric material and contributes to a longer cycle life.

Various modifications and alterations in the described apparatus will be apparent to those skilled in the art from the foregoing description which does not depart from the spirit of the invention. The foregoing disclosure and description of the invention are illustrative and explanatory thereof and details of the illustrative embodiment may be made without departing from the spirit of the invention.

What is claimed is:

1. An insert adapted for use in an annular blowout preventer packing unit having a longitudinal axis, the packer having an annular elastomeric body in which one or more of the inserts are embedded comprising, top and bottom plates interconnected solely by a generally longitudinal web, the inner edge of the web sloping generally from a relatively smaller radius near the top plate to a relatively greater radius near the bottom plate.

2. In an insert adapted for use in an annular blowout preventer packing unit and having top and bottom plates interconnected solely by a generally longitudinal web, the improvement comprising, the inward edge of the web sloping generally radially inward to radially outward from the connection to the top plate to the bottom plate.

3. An insert for an annular packing unit having an axial bore comprising, a top plate, a bottom plate, and a web integral with and providing the sole connecting means for connecting the top and bottom plates, the inner edge of the web sloping downwardly in an outward radial direction from the axis of the bore.

4. The insert of claim 3 in which the inner edge of the web is generally sloped at a positive angle within a range of from six to twelve degrees with respect to the axis of the bore.

5. A packer unit adapted for use in an annular blowout preventer having an axial bore, the packer unit adapted for compressive solely inward radial displacement toward the axis of the bore, the packer unit comprising, metallic inserts generally spaced circularly about the axis, the inserts having webs which extend generally longitudinally, the inward edge of the webs sloping generally downwardly in an outward radial direction from the axis of the bore, and an annulus of elastomeric material extending about the axis and embedding the webs so that the webs anchor the material during inward compressive displacement of the packer.

6. The packer unit of claim 5 wherein the inserts have top and bottom plates integral with the webs, the webs providing the sole means for connecting the top and bottom plates, the plates circularly spaced about the axis.

7. The packer unit of claim 5 in which the inward edge of the webs are generally sloped at a positive angle from a range of six to twelve degrees with respect to the axis of the bore of the packer unit.

8. An improved packing unit adapted for use in an annular blowout preventer having a longitudinal axial bore, the packing unit adapted for compressive solely inward radial displacement toward the axis of the bore and having metallic inserts generally circularly spaced about the axis, the inserts having webs which extend generally longitudinally and top and bottom plates integral with the webs, the webs providing the sole connecting means between the top and bottom plates, the packing unit having an annulus of elastomeric material extending about the axis and embedding the webs, wherein the improvement comprises the inner edge of the webs sloping generally from top to bottom in a radially outward direction whereby relatively more elastomeric material is provided lower in the packer unit with the result that during radially inward compressive displacement of the packer, the axial pressure profile on a pipe or other object in the axial bore of the packer is shifted axially to a relatively lower position within the packer, thereby resulting in a relatively longer cycle life of the packing unit.

* * * * *